US007278869B1

(12) United States Patent
Bernhart et al.

(10) Patent No.: US 7,278,869 B1
(45) Date of Patent: Oct. 9, 2007

(54) CONFINED ENVELOPE CONNECTOR SYSTEM

(75) Inventors: William Henry Bernhart, Monroe, WA (US); Kenneth P. Dowhower, Harrisburg, PA (US); George H. Douty, Mifflintown, PA (US); John A. Fulponi, Harrisburg, PA (US); Robert Charles Flaig, Lancaster, PA (US); Galen Martin, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/676,192

(22) Filed: Feb. 16, 2007

(51) Int. Cl.
*H01R 13/62* (2006.01)

(52) U.S. Cl. ..... 439/310

(58) Field of Classification Search ..... 439/310, 439/347, 374, 157, 34; 244/118.6
See application file for complete search history.

(56) References Cited

U.S. PATENT DOCUMENTS

| | | | | |
|---|---|---|---|---|
| 4,776,533 | A | 10/1988 | Sheek et al. | |
| 6,155,850 | A | 12/2000 | Martin et al. | |
| 6,200,164 | B1 | 3/2001 | Martin et al. | |
| 6,260,813 | B1 | 7/2001 | Whitcomb | |
| 6,601,798 | B2 | 8/2003 | Cawley | |
| 6,659,402 | B1 * | 12/2003 | Prochaska | 244/118.6 |
| 6,886,797 | B2 | 5/2005 | McCullen et al. | |
| 6,929,218 | B1 | 8/2005 | Sanford et al. | |
| 6,964,481 | B2 | 11/2005 | Pho et al. | |
| 7,086,874 | B2 | 8/2006 | Mitchell et al. | |
| 7,172,155 | B2 * | 2/2007 | Feist et al. | 244/118.6 |
| 7,182,292 | B2 | 2/2007 | Howard et al. | |
| 7,185,850 | B2 | 3/2007 | Callahan et al. | |
| 7,207,523 | B2 | 4/2007 | Callahan et al. | |
| 2006/0102784 | A1 | 5/2006 | Callahan et al. | |

OTHER PUBLICATIONS

"Wire-to-Aggregate Connectors", Tyco Electronics Catalog No. 1654300; Issued Oct. 2004, pp. 422 and 424; Harrisburg, PA.

* cited by examiner

*Primary Examiner*—Phuong K T Dinh

(57) ABSTRACT

An electrical connector system is adapted for placement into a recessed space defining a raceway formed in a floor of an aircraft having an open region. The electrical connector system includes a first connector and a second connector connectable along a first axis. A frame is provided. The first connector is selectably movable in the frame along the first axis in response to movement of a frame portion, with the second connector being constrained by the frame to resist movement along the first axis. Movement of the frame portion permits selective engagement and disengagement between the first and second connectors, the frame portion being accessible from the open region.

20 Claims, 11 Drawing Sheets

CONFINED ENVELOPE CONNECTOR SYSTEM

FIELD OF THE INVENTION

The present invention is directed to an electrical connector system, and more specifically to an electrical connector system configured for mounting in confined and/or recessed spaces.

BACKGROUND OF THE INVENTION

Connectors are required to provide electrical power or electrical or electronic control signals between components, such as computers, printers, auxiliary hardware, etc. It is desirable for the connectors and connections therebetween to be configured to provide maximum clearance for living or working space. While the size of fasteners can be reduced, alternatively and/or additionally, the connectors can be installed in confined or recessed spaces within the structure of the components in which they are used.

Unfortunately, there are drawbacks associated with locating electrical connectors in confined or recessed spaces. First, accessibility and installation can be problematic, requiring specially configured tools, often in combination with the connectors being installed in positions that present awkward or difficult access. Typically, a further drawback is the necessity to remove the connectors from the confined or recessed space merely to connect or disconnect the connectors. Additionally, while the connectors and connections may be relatively "out of the way," such as by setting the connectors in a recessed passage along a walking surface, the connectors may be susceptible to damage from foreign matter, including liquid spillage.

What is needed is a connector system that can quickly and easily be installed in confined or recessed spaces manually or with standard hand tools, is capable of being connected or disconnected while the connectors remain in the confined or recessed space, and permits sufficient access to the connectors to achieve connection/disconnection with such access substantially not extending into the space.

SUMMARY OF THE INVENTION

The present invention relates to an electrical connector system adapted for placement into a recessed space defining a raceway formed in a floor of an aircraft having an open region. The electrical connector system includes a first connector and a second connector connectable along a first axis. A frame is provided. The first connector is selectably movable in the frame along the first axis in response to movement of a frame portion, with the second connector being constrained by the frame to resist movement along the first axis. Movement of the frame portion permits selective engagement and disengagement between the first and second connectors, the frame portion being accessible from the open region.

The present invention further relates to an electrical connector system adapted for placement into a recessed space defining a raceway formed in a floor of an aircraft having an open region. The electrical connector system includes a first connector and a second connector connectable along a first axis. A third connector and a fourth connector are connectable along a second axis. A first frame is provided. The first connector is selectably movable in the first frame along the first axis in response to movement of a first frame portion, the second connector constrained by the first frame to resist movement along the first axis. A second frame is provided. The third connector is selectably movable in the second frame along the second axis in response to movement of a second frame portion, the fourth connector constrained by the second frame to resist movement along the second axis. Movement of the first and second frame portions permit selective engagement and disengagement between the first and second connectors and between the third and fourth connectors, each of the first and second frame portions being accessible from the open region.

An advantage of the present invention is that the connector system can be placed in a confined or recessed space.

A further advantage of the present invention is that access to the installed connection system does not require access to connect or disconnect the connectors, as such access substantially does not extend inside the space.

A still further advantage of the present invention is that when installed, the connection system substantially prevents foreign matter from reaching the confined and/or recessed space.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
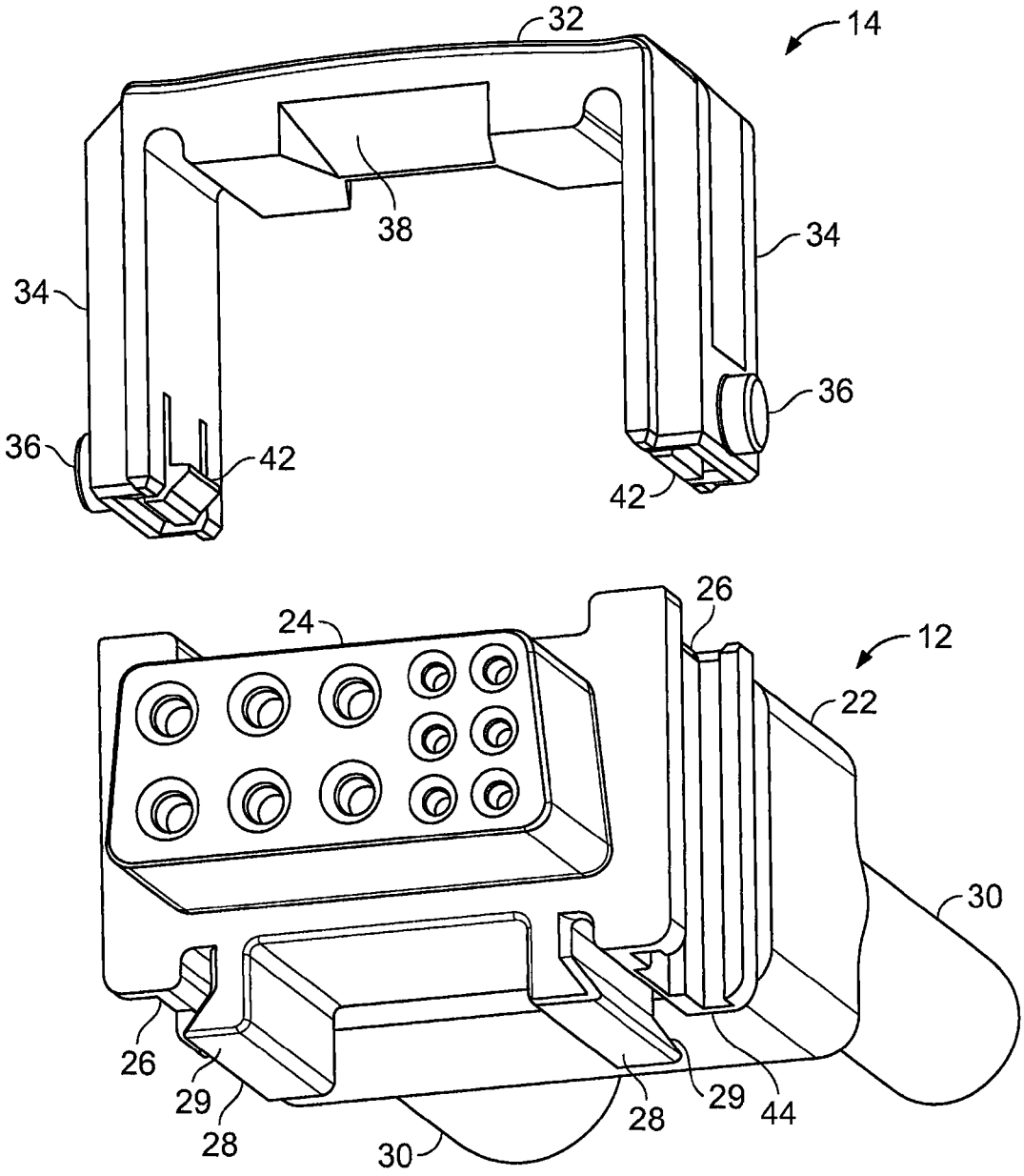
FIG. 1 is an exploded perspective view of an embodiment of a connector and frame portion of the connection system of the present invention.

The present invention is directed to an electrical connector system 10 permitting selective connection/disconnection or engagement/disengagement of connectors 12, 20 as shown in FIGS. 1, 3, 4, 5 and 6. A frame 16 (see e.g., FIG. 2) is configured to fit within a confined or recessed space. Frame 16 is also configured to slidably receive connector 12 that is urged into driven movement along an axis 58 (FIG. 5) by the interaction of a frame portion 14, connector 12 and frame 16. This interaction, which is discussed in additional detail below, permits selective connection/disconnection between connector 12 and connector 20 (FIG. 5) while requiring only minimal access to the connector system 10. Such access substantially does not extend into the confined or recessed space occupied by the connector system. In addition, provision of a cover 18 and/or a hollow body 86 (see e.g., FIG. 6) permits the connector system 10 to substantially prevent foreign matter, including liquids, from reaching the confined or recessed space in which the connector system is secured.

Figure 2:
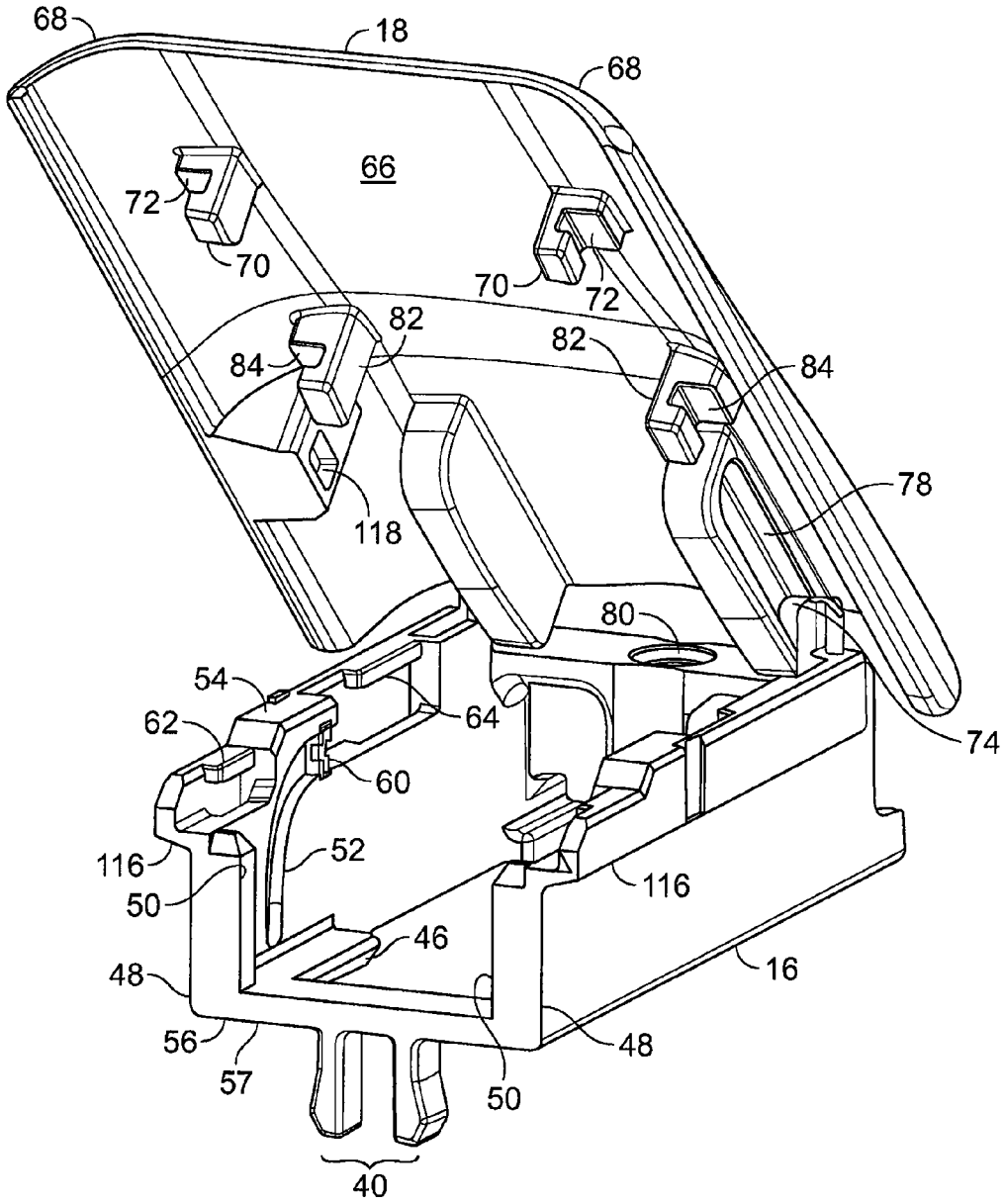
FIG. 2 is a perspective view of a frame and cover used with the connector system of the present invention.

Referring to FIGS. 1 and 2, connector 12 includes a body 22 having a receptacle portion 24 for receiving a plug portion 25 (FIG. 6) from a connector 20 (FIG. 6) for establishing an electrical connection therebetween. A wire boot 30 extends opposite receptacle portion 24 of connector 12 to protect electrical wires (not shown) that extend through frame 16. It is to be understood that while connector 12 shows a plug construction and connector 20 shows a receptacle construction, the arrangement could be switched without altering the advantages of the present invention. To slidably secure connector 12 within frame 16, a pair of rails 28 extend from body 22, each rail preferably having an angled portion 29, forming a dovetail half. However, it is to be understood that rail 28 constructions are not limited to dovetails. Rails 28 are received by a pair of guides 46 disposed adjacent a lower surface 56 of an end 57 of frame 16, forming a dovetail joint therebetween. A channel 26 extends along each of opposite sides of body 22 to slidably receive a frame portion 14.

Further referring to FIGS. 1 and 2, frame portion 14 includes a base 32 extending at opposite ends to a pair of parallel legs 34 that are substantially perpendicular to the frame portion 14. Adjacent the end of each leg 34 opposite base 32 is a lobe 36 extending substantially perpendicularly away from the opposite leg. Each leg 34 of frame portion 14 is received in a corresponding channel 26 of body 22 of connector 12. For assembly into frame 16, each leg 34 of frame portion 14 is brought into engagement with a corresponding channel 26 of body 22 and inserted inside of frame 16 such that each lobe 36 engages a corresponding slot 52 formed in opposite walls 48 of the frame.

Figure 3:
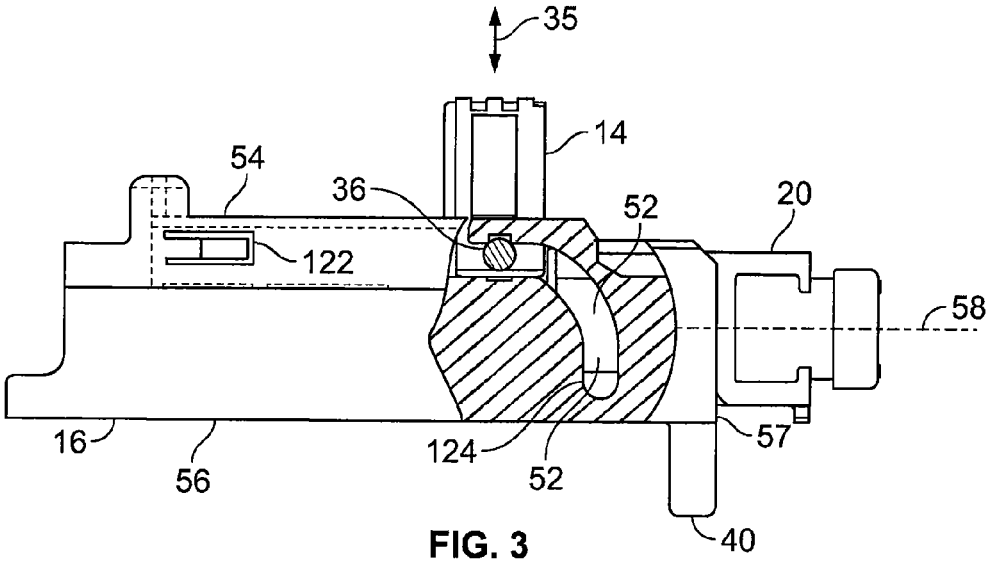
FIGS. 3-4 are partial cutaway side views of different slot constructions used with the frame of FIG. 2 of the present invention.
Figure 4:
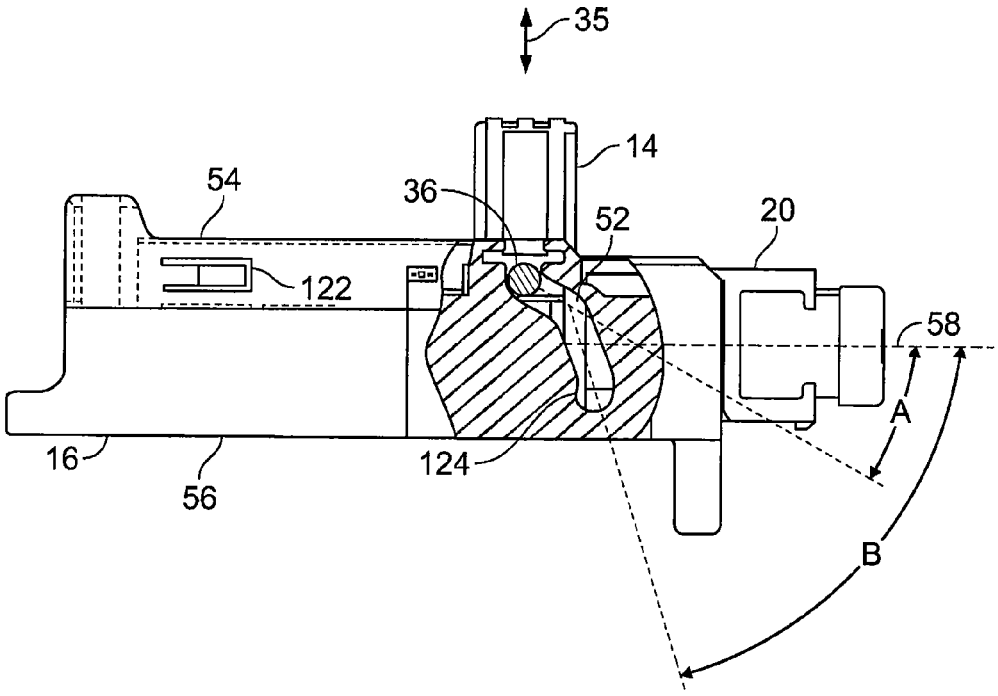

Referring to FIGS. 3-4, which are partial cutaway side views of frame 16, several embodiments of slot 52 paths are shown. Slots 52 are substantially aligned with each other. In an embodiment in which frame 16 is rectangular, slots 52 are configured in any configuration to slidably receive lobes 36 to position frame portion 14. However, it is to be understood that geometries of features of frame 16 can differ from a rectangular construction, so long as lobes 36 of frame portion 14 are slidably received in slots 52.

As further shown in FIGS. 3-4, lobe 36 of frame portion 14 is constrained to move along slots 52 and as shown in FIG. 1, the frame portion 14 is constrained to move along channel 26. In other words, in response to movement parallel to either of directions 35 (due to channel 26), lobe 36 is additionally constrained to move in a predetermined path defined by slots 52, which defines a combination of directions 35 and axis 58. That is, due to sliding engagement between frame portion 14 and connector 12 along channel 26 of connector 12, channel 26 being parallel to directions 35 in one embodiment, frame portion 14 simultaneously moves in directions 35 and axis 58. However, connector 12 is constrained to move only along axis 58 by virtue of guided engagement between rails 28 (FIG. 1) and guide 46 (FIG. 2).

Slots 52 can define different predetermined paths. As shown in FIG. 3, slot 52 defines a curved path, such as a curved, parabolic path. In one embodiment slot 52 proceeds parallel or nearly parallel to axis 58 when lobe 36 is adjacent upper surface 54 of frame 16. The angle between axis 58 and the tangential contact between lobe 36 and the slot 52 increases as the slot 52 proceeds toward lower surface 56. This construction provides a mechanical advantage to transmit a force applied along direction 35 to frame portion 14 to produce a force of increased magnitude that is applied to urge connector 12 (FIG. 1) along axis 58. Using similar rationale, FIG. 4 shows an alternate slot 52 path, in which the path includes two angularly directed substantially linear portions. However, it is to be understood that slot 52 can define a linear, as well as a curved path, or combination thereof. The first angular portion is disposed at an angle "A" between axis 58 and the centerline of slot 52, while the second angular portion is disposed at an angle "B" between axis 58 and the centerline of slot 52. Angle B is greater than angle A and provides increased mechanical advantage as lobe 36 approaches lower surface 56. The mechanical advantage permits convenient connection/disconnection between connector 12 (FIG. 1) and connector 20.

Figure 5:
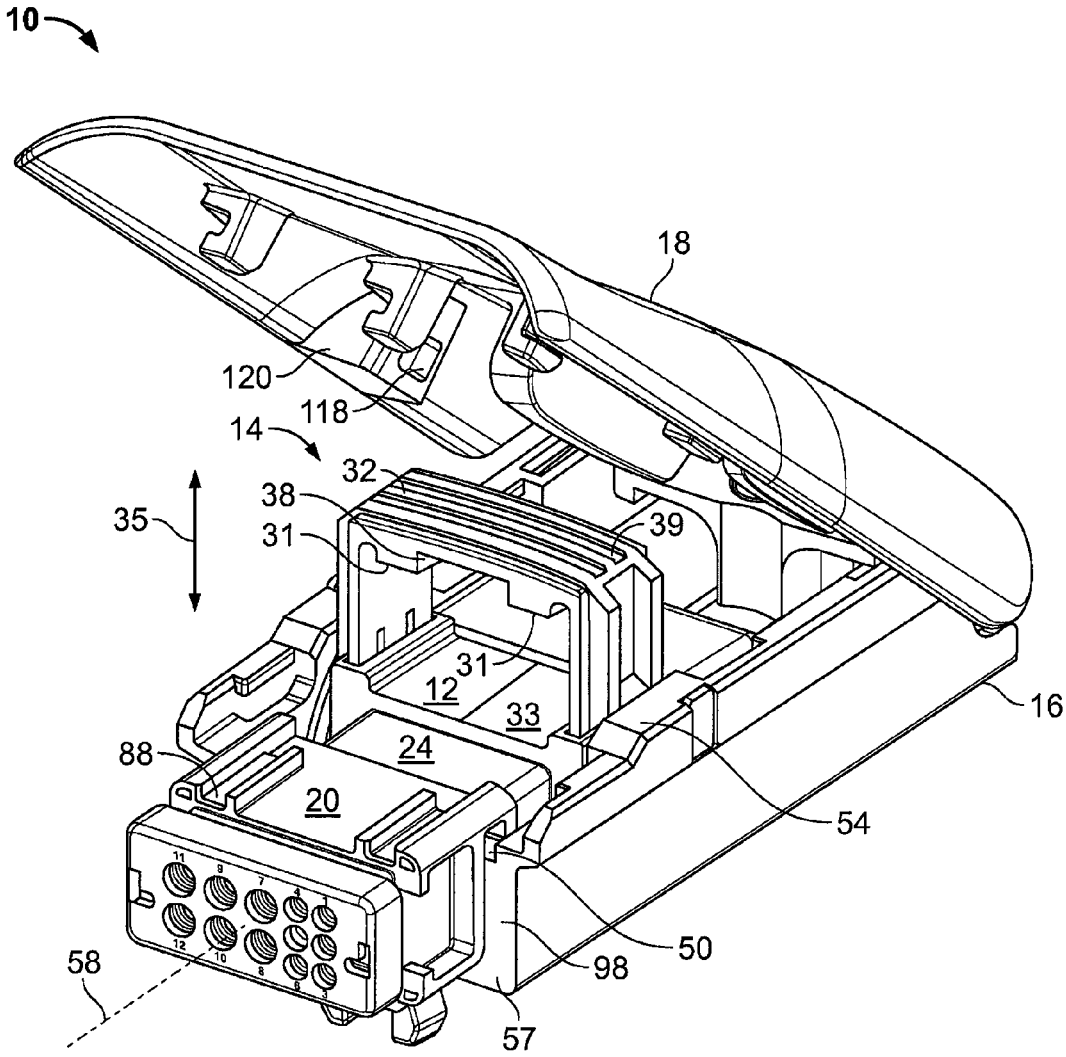
FIG. 5 is a perspective view of an embodiment of a connector system of the present invention.

As shown in FIG. 5 of connector system 10, connector 20 includes a pair of opposed channels 98 that engages a corresponding pair of opposed guides 50 formed adjacent end 57 of frame 16. That is, connector 20 is constrained to move, if it is to move at all, along guides 50. Guides 50 and axis 58 are disposed substantially perpendicular to each other, so that in response to subjecting connector 20 to a force directed along axis 58, connector 20 resists movement in a direction along guides 50. In other words, when frame portion 14 is subjected to a force in either of directions 35, connector 12 is urged along axis 58, while connector 20 is constrained by frame 16 to substantially not move along axis 58, thereby permitting selective engagement/disengagement or connection/disconnection between connectors 12, 20.

Referring to FIG. 5, engagement/disengagement or connection/disconnection between connectors 12, 20 is achieved when frame portion 14 is disposed in two different positions with respect to frame 16. In one position, as shown in FIG. 5, which is referred to as a disengaged or disconnected position, i.e., when connectors 12, 20 are disengaged or disconnected, base 32 of frame portion 14 is disposed at, or adjacent to, a maximum distance from upper surface 33 of connector 12. As shown in FIGS. 3 and 4, the maximum distance of frame portion 14 occurs when lobe 36 is in relative proximity to upper surface 54 of frame 16. As shown in FIG. 2, a retainer 60 prevents inadvertent removal of lobe 36 from slot 52, or movement past the disengaged or disconnected position.

The other position is referred to as the engaged or connected position, in which connectors 12, 20 are engaged or connected to each other. FIG. 10 shows frame portion 14 in the engaged or connected position, in contrast to FIG. 9, which shows the frame portion in the disengaged or disconnected position. In the engaged or connected position, referring to FIGS. 3-5, lobe 36 of frame portion 14 is urged to a position along slot 52 that is adjacent lower surface 56 of frame 16. Similarly, referring to FIG. 5, this coincides with base 32 of frame portion 14 being directed toward an upper surface 33 of connector 12 until shoulders 31 extending from the lower surface of base 32 are closely adjacent to, if not in abutting contact with, upper surface 33. As shown in FIGS. 1 and 3, to retain frame portion 14 in the engaged or connected position, a lobe 36 engages a recess 124 formed in slot 52 in relative proximity of surface 56. To actuate frame portion 14 from the engaged or connected position (FIG. 10) toward the disengaged or disconnected position (FIGS. 5, 9), a tapered access 38 (FIG. 5) is provided. An end of a narrow, flat instrument (not shown), such as the tip of a blade-type screwdriver, can be directed into access 38 and then rotated to produce a prying force between the frame portion 14 and connector 12 to urge frame portion 14 in a direction away from connector 12.

In one embodiment, referring to FIGS. 5 and 10, an upper surface 39 of base 32 of frame portion 14 is substantially flush or coincident with upper surface 54 when the frame portion is in the engaged or connected position. That is, upon placement of the connector system 10 in a recessed space (not shown) in which the recess substantially completely receives the connector system, i.e., upper surface 54 of frame 16 is substantially flush with the surface immediately surrounding the recess, the upper surface 39 of frame portion 14 is also substantially flush with the surface immediately surrounding the recess. To clarify, for purposes of this discussion, frame portion 14 is considered part of the frame 16. Similarly, the term access is intended to refer to accessing frame portion 14. Therefore, access to the frame, such access permitting selective engagement or disengagement between connectors 12, 20, substantially does not extend into the recess. That is, once the connector system of the present invention is installed in a confined or recessed space or envelope, the extent of access required to connect/disconnect the connectors of the connector system substantially does not require extending into the confined or recessed space or envelope.

Referring back to FIG. 2, in one embodiment, frame 16 can be secured within a recessed or confined space by features, such as a retainer 40, which extends from lower surface 56 and has outwardly tapered fingers for retention in an aperture (not shown) formed in the space. Optionally, retention is also provided by a fastener (not shown) that extends through aperture 80 and into the recessed space. Fasteners can include, but are not limited to, screws, bolts, quick release fasteners, including spring actuated plungers and other types of devices suitable to secure frame 16 in a desired position in a confined or recessed space.

Frame 16 includes a cover 18 that is both pivotably and slidably connected to a pair of slots 78 extending from a lower surface 66. Slots 78 are received by a pair of inwardly directed lobes 74 extending from upper surface 54 of frame 16. When lobes 74 are disposed adjacent one end of slot 78 as shown in FIG. 2, cover 18 can be opened similar to a clam shell about the lobes 74 to access components housed within frame 16. However, when cover 18 is closed so that lower surface 66 is brought into close proximity with upper surface 54 of frame 16, cover 18 can be placed in a locked position or locking engagement over the frame. When cover 18 is closed over frame 16, pairs of retainers 70, 82, which extend outwardly from upper surface 66, are brought adjacent to respective pairs of ridges 62, 64. A slot 72 formed in each retainer 70 and a slot 84 formed in each retainer 82 are also brought into alignment with corresponding ridges 62, 64. The locked engagement is then achieved by directing cover 18 into movement with respect to frame 16, i.e., toward lobes 74, while lobes 74 are in sliding engagement with slot 78, until slot 118 of cover 18 receives a latch 122 (FIGS. 3, 4) of frame 16. That is, while lobes 74 proceed along corresponding slots 78 toward the opposite end of slot 78 toward retainers 82, slots 72 engage corresponding ridges 62 and slots 84 engage corresponding ridges 64 until slot 118 of cover 18 receives latch 122 (FIGS. 3, 4) of frame 16. In one embodiment, an audible "click" is produced when slot 118 and latch 122 are brought together in mating engagement. When frame 16 is placed in a recess (not shown) such that the surface immediately surrounding the recess abuts shoulder 116, cover 18 provides a foreign object barrier or shield along the majority of the periphery of the cover. That is, downwardly sloping opposed edges 68 are brought into close proximity between cover 18 and the surface surrounding the recess to form a foreign object barrier or shield to reduce the amount of foreign matter accessing the portion of the recess occupied by the cover.

Figure 6:
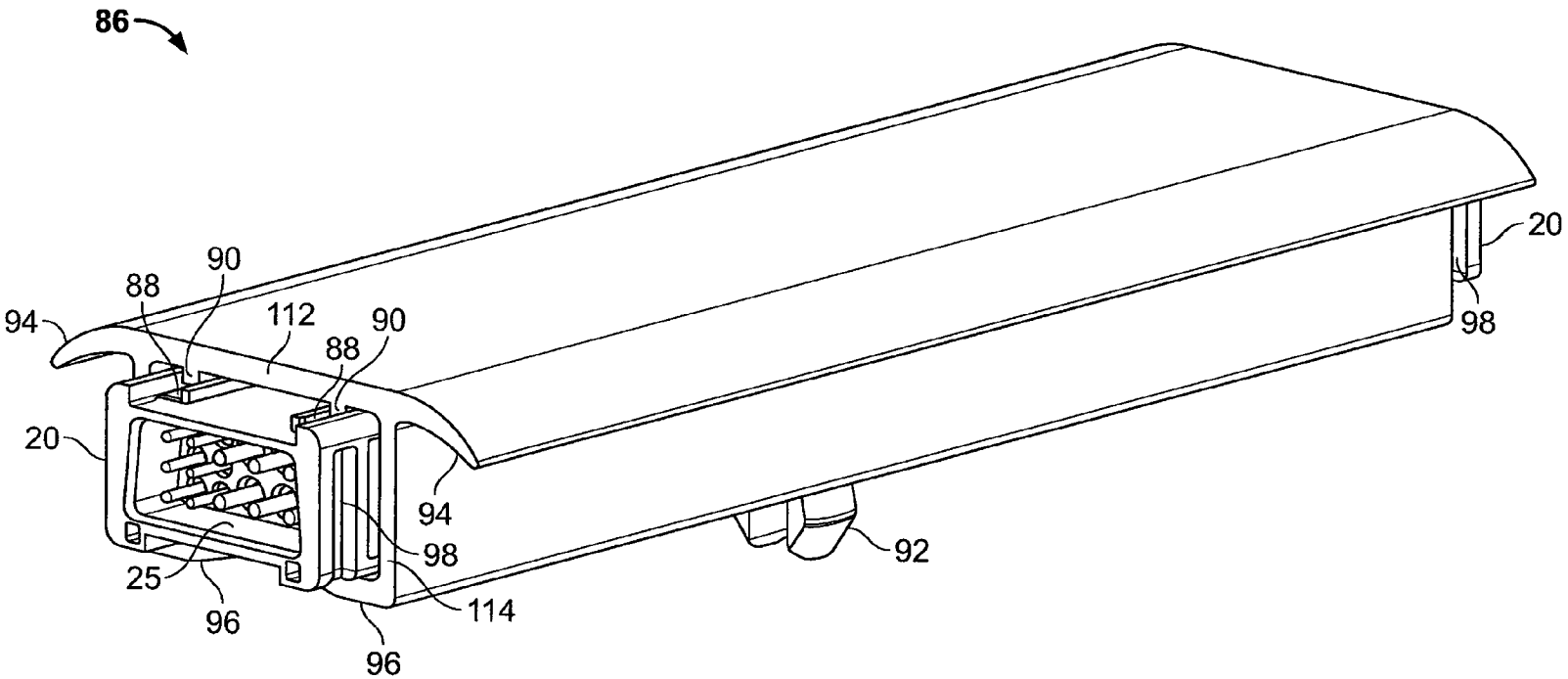
FIG. 6 is a perspective view of a body used to bridge opposed connector systems of the present invention.

In an embodiment of the invention, referring to FIG. 6, a hollow body 86 can be used to connect two connector systems 10, as shown, for example, in FIGS. 7-11. Body 86 includes opposed ends to each receive connector 20, each end including a pair of protrusions 90 extending away from an upper portion 112. Connector 20 includes a pair of slots 88 each receiving a corresponding protrusion 90 to maintain the desired alignment of the connector in body 86. Extending from upper portion 112 are a pair of parallel walls 114 that are substantially perpendicular to the upper portion. Upper portions 112 further extend to flanged ends 96 that extend toward each other and are mutually parallel. Ends 96 include a spacing therebetween to permit connectors 20 to be connected by wires or other suitable connection (not shown) installed into body 86. Also, as shown in FIG. 6, upper portion 112 extends outwardly to form tapered flanges 94 at opposite ends of the upper portion. To secure body 86 in a recessed or confined space, a retainer 92 is provided that extends from ends 96 and having outwardly tapered fingers for retention in an aperture (not shown) formed in the space. In addition, retainer 92 is also an alignment feature as space apertures 110 (FIG. 7) are uniformly spaced. Body 86 can be cut to length to fit between adjacent connector systems 10, as shown in one application in FIGS. 7-12.

Figure 7:
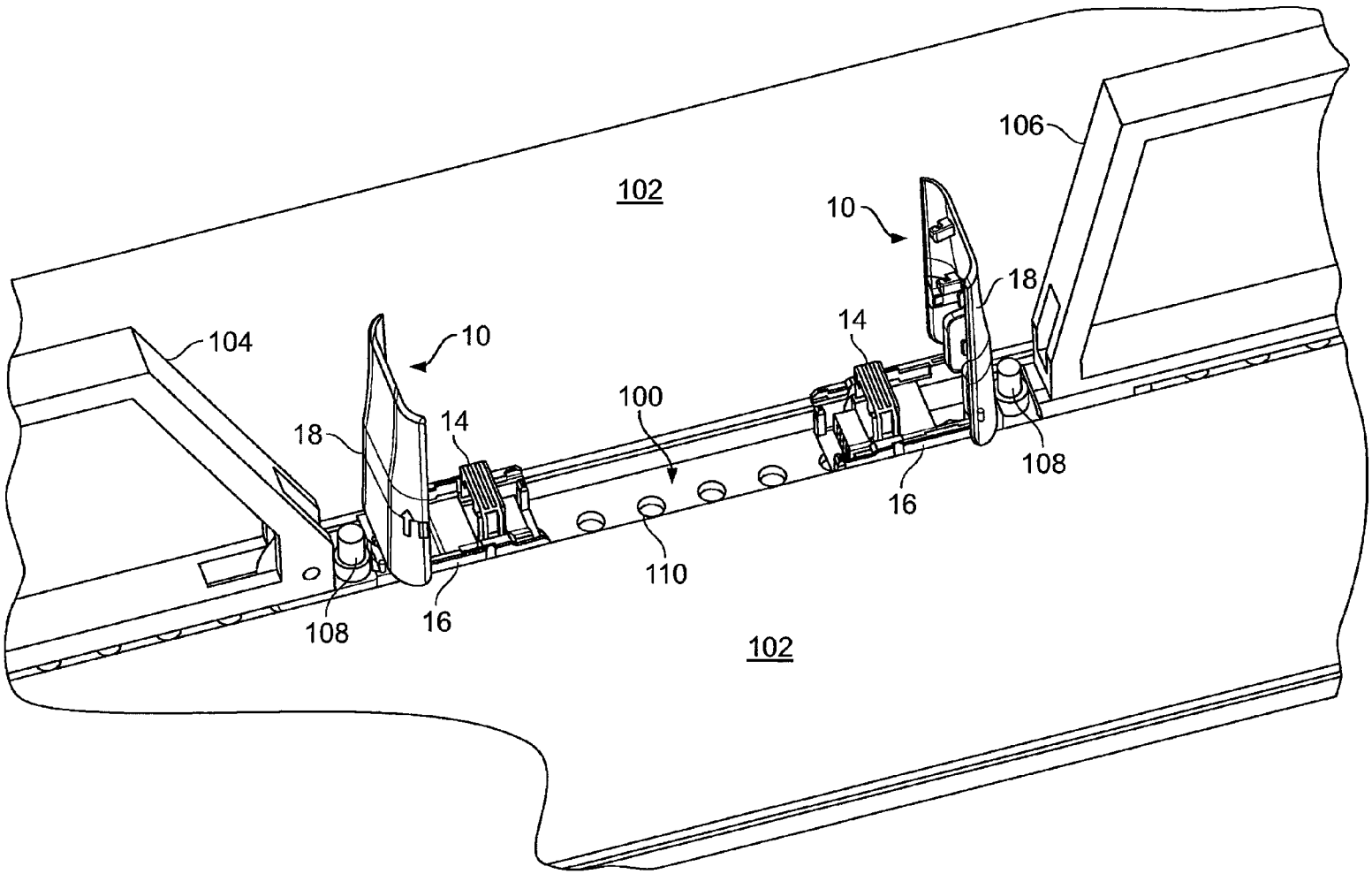
FIGS. 7-12 show sequential steps associated with installing an embodiment of the connector system in an aircraft application of the present invention.
Figure 8:
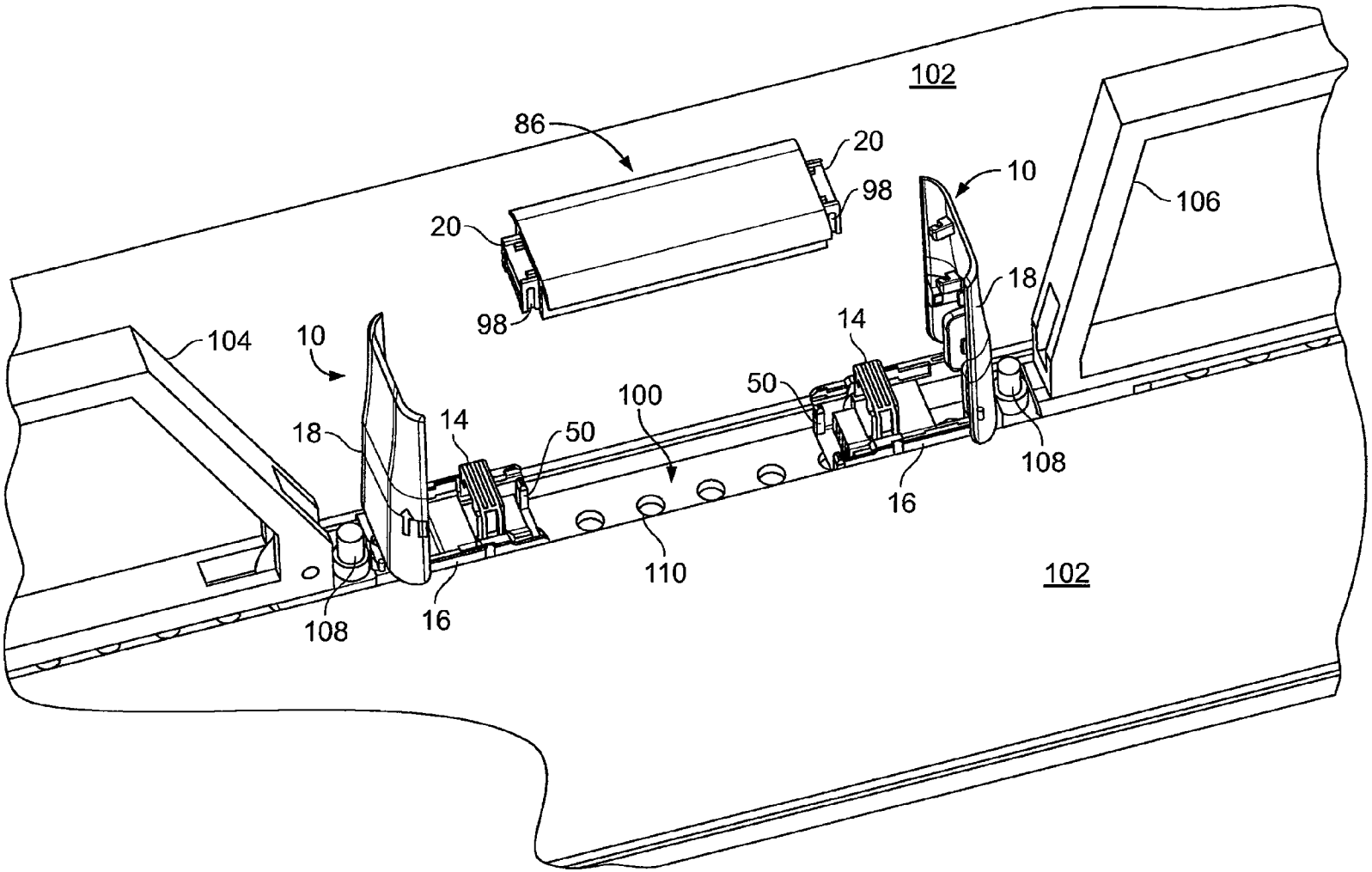
Figure 9:
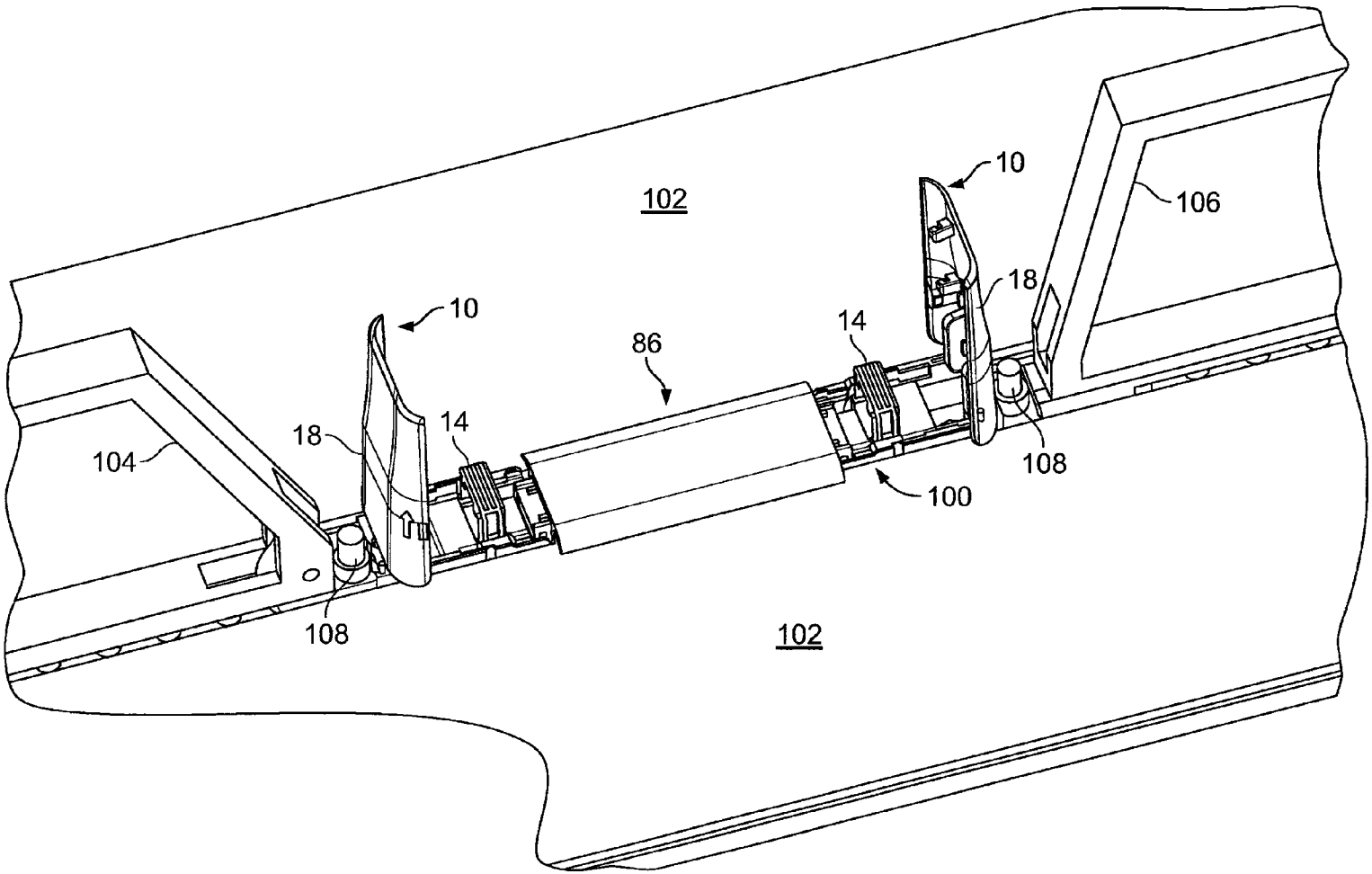
Figure 10:
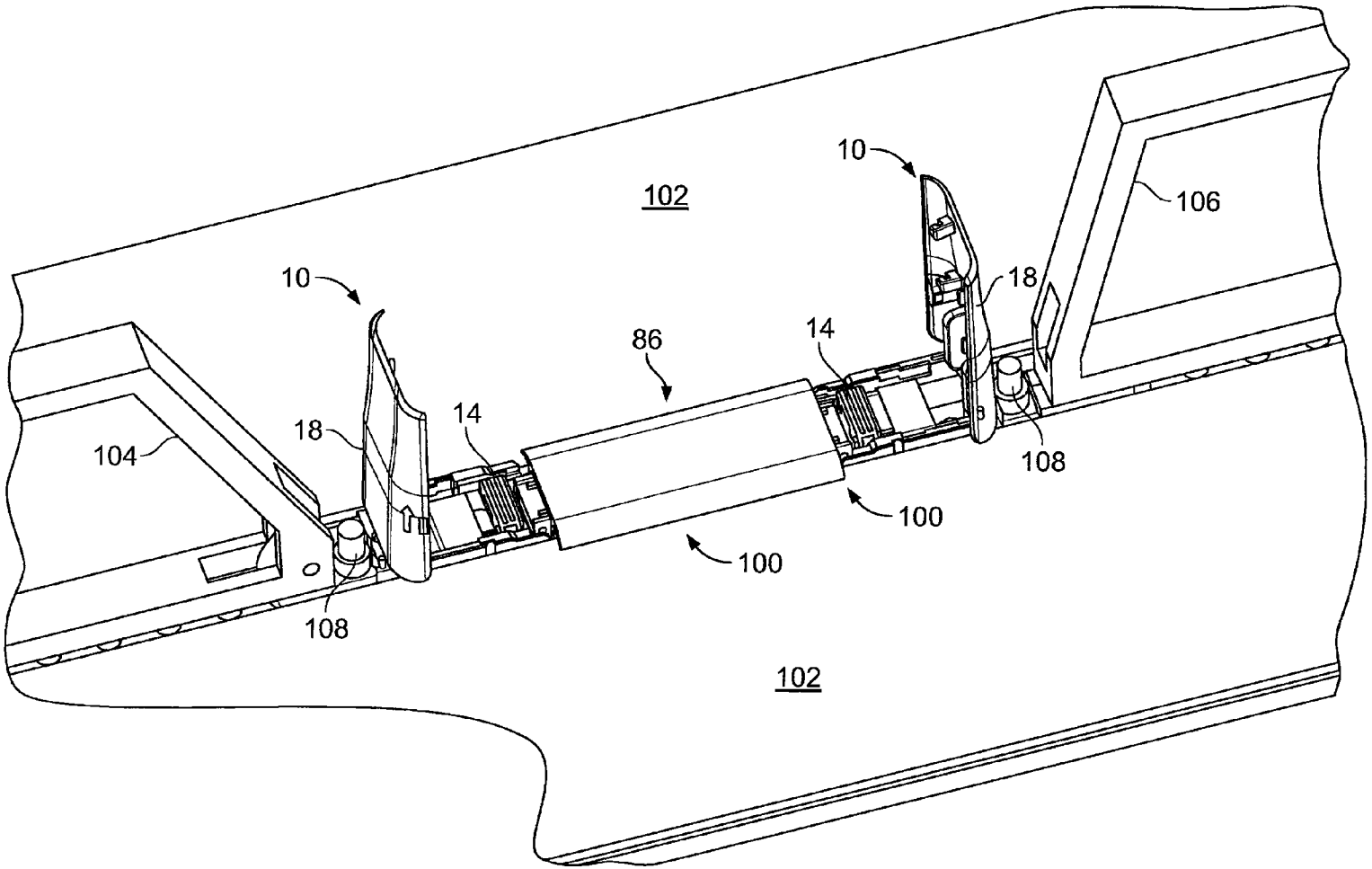
Figure 11:
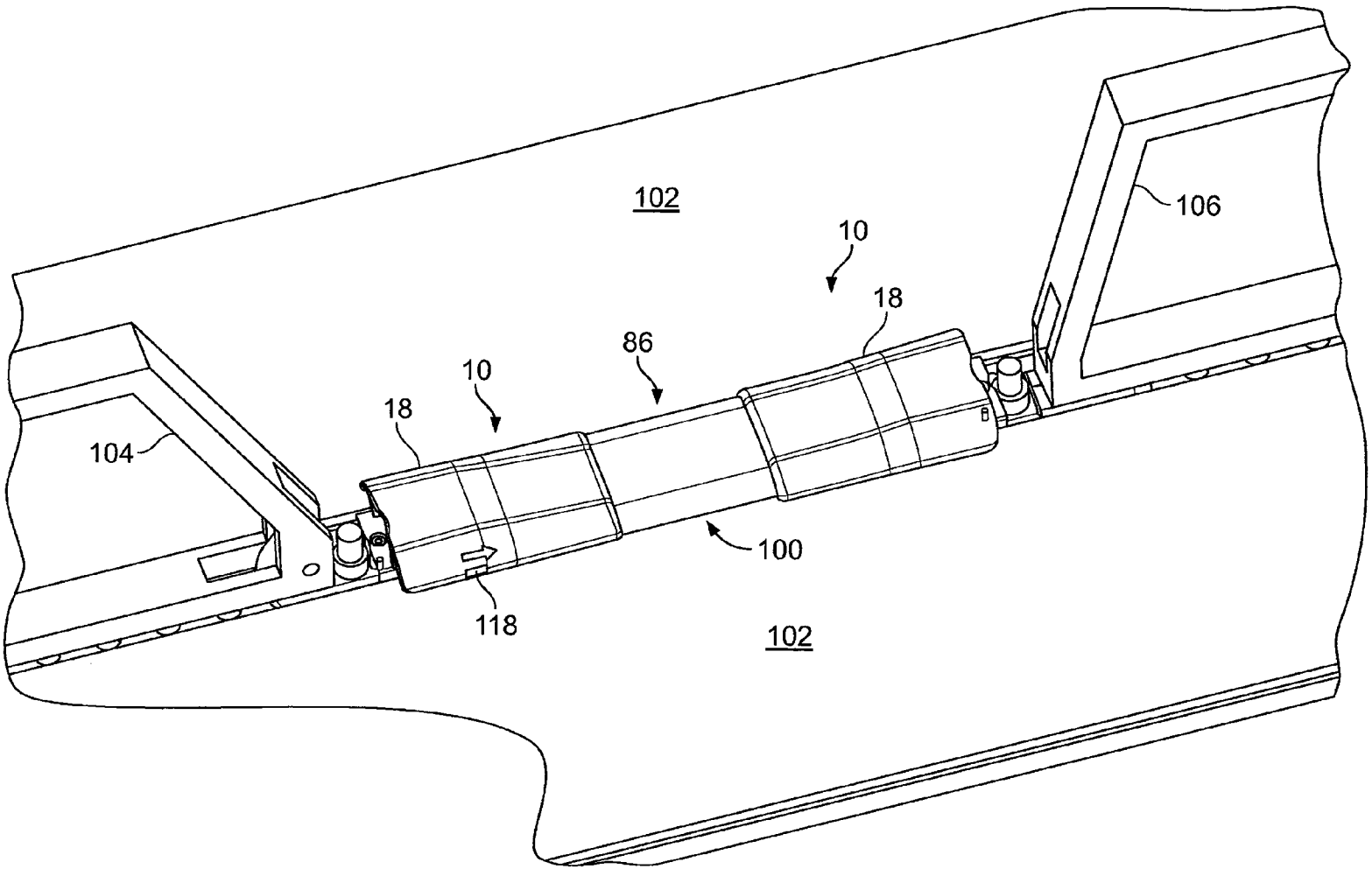
Figure 12:
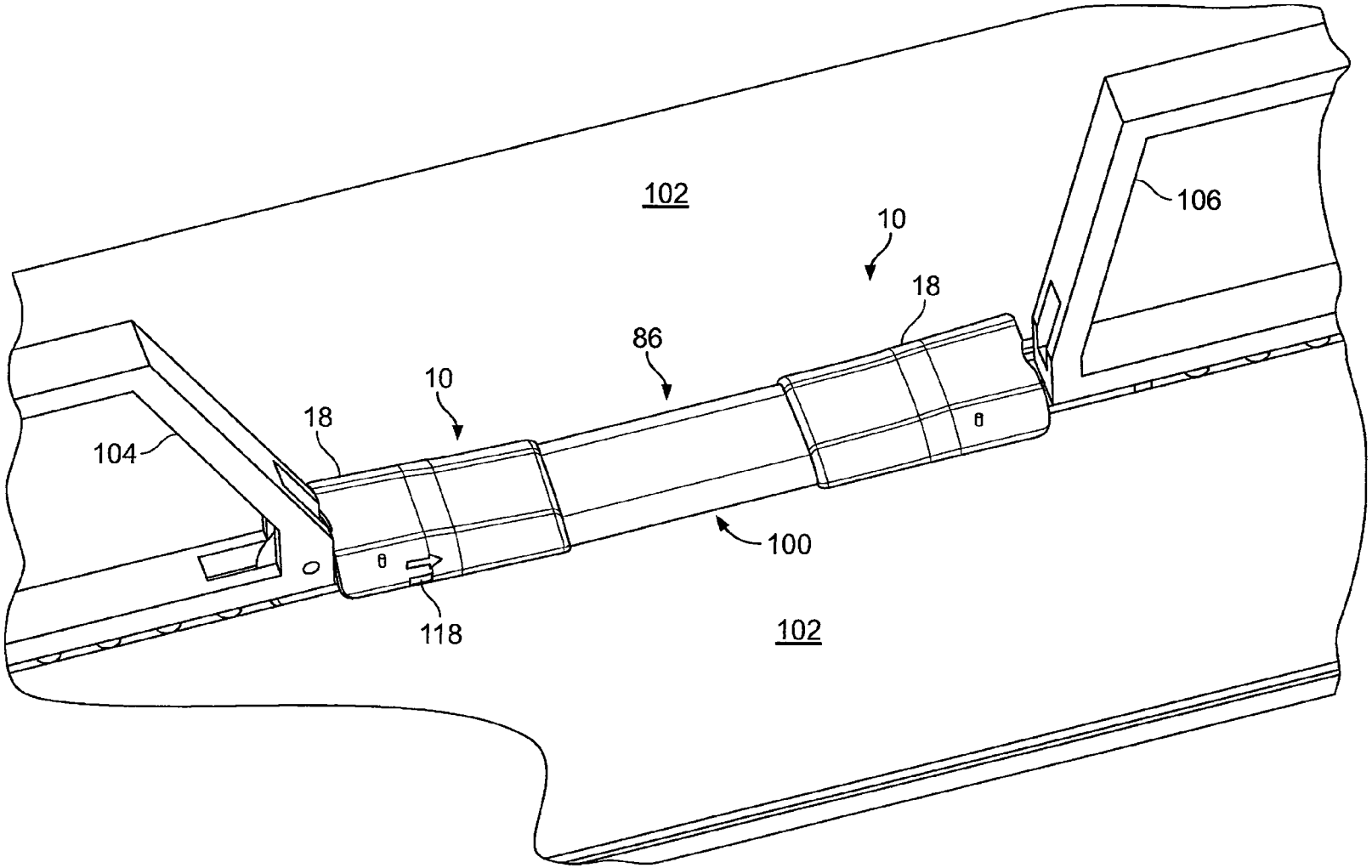

FIGS. 7-12 show sequential steps associated with installing an embodiment of the connector system in an aircraft application, for example. As shown, body 86 is disposed between two connector systems 10 that are collectively installed in a recessed space or track 100 formed in a floor 102 of a commercial aircraft. Track 100 includes uniformly spaced apertures 110 to secure aircraft seats, such as by fastener 108, which is used to secure both the corresponding aircraft seat leg 104, 106 and frame 16 of each connector system 10, as shown in FIG. 7. Leg 104, which is an aft leg of an aircraft seat, is disposed in front of forward leg 106 of an adjacent aircraft seat that is in the same row as the seat having leg 104, but behind the seat having leg 104. FIGS. 8-9 show the steps of presenting and installing body 86 between adjacent connector systems 10. FIG. 10 shows frame portions 14 being actuated to define an engaged or connected position to connect connectors 12, 20 (FIG. 5) as previously discussed. It is appreciated that access required to actuate frame portion 14 is a confined open region immediately above and adjacent the frame portion, but does not require access from within track 100. FIG. 11 shows covers 18 and body 86 forming a shield or barrier to reduce the amount of foreign matter reaching recess or track 100. As is appreciated, movement of covers 18 required to lock the covers against floor 102, as previously discussed, are also sufficient to hide, and therefore protect, fasteners 108 (FIGS. 7-10). To permit subsequent access to the connectors of the connector system 10, a slot 118 is formed in each cover 18. Slot 118 includes stiffening structure 120 surrounding slot 118 (FIG. 5) to provide sufficient structural strength and stiffness to withstand the forces associated with use of a narrow tool, such as a blade-type screwdriver.

It is to be appreciated that while an aircraft application is shown in one embodiment, the connector system of the present invention can be used with any vessel or apparatus using connectors that can benefit from locating the connectors in a confined and/or recessed space.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector system adapted for placement into a recessed space defining a raceway formed in a floor of an aircraft having an open region, the electrical connector system comprising:

a first connector and a second connector connectable along a first axis;

a frame, the first connector selectably movable in the frame along the first axis in response to movement of a frame portion, the second connector constrained by the frame to resist movement along the first axis; and wherein movement of the frame portion permits selective engagement and disengagement between the first and second connectors, the frame portion being accessible from the open region.

2. The connector system of claim 1 including a cover pivotably connected to the frame, the cover movable to a locking engagement over the frame, upon engagement between the first and second connectors.

3. The connector system of claim 2 wherein the cover is slidably movable to a locking engagement over the frame.

4. The connector system of claim 2 wherein the locking engagement is achieved by a latch formed in the frame.

5. The connector system of claim 2 wherein the cover includes a slot to receive a tool to actuate the cover away from the locking engagement over the frame.

6. The connector system of claim 5 wherein the tool is a blade-type screwdriver.

7. The connector system of claim 1 wherein the frame includes features for securing the frame in the space.

8. The connector system of claim 1 wherein the frame includes a pair of slots defining a predetermined path formed in opposed sides of the frame;

the frame portion having a pair of lobes, each lobe slidably received in a corresponding slot, the frame portion being substantially vertically slidably movable with respect to the first connector; and wherein in response to substantially vertical sliding movement of the frame portion, the first connector moves along the first axis.

9. The connector system of claim 8 wherein the predetermined path is curved.

10. The connector system of claim 8 wherein the predetermined path comprises one or more angles.

11. The connector system of claim 10 wherein the angled path contains at least two portions having different slope from the first axis.

12. An electrical connector system adapted for placement into a recessed space defining a raceway formed in a floor of an aircraft having an open region, the electrical connector system comprising:

a first connector and a second connector connectable along a first axis;

a third connector and a fourth connector connectable along a second axis;

a first frame, the first connector selectably movable in the first frame along the first axis in response to movement of a first frame portion, the second connector constrained by the first frame to resist movement along the first axis;

a second frame, the third connector selectably movable in the second frame along the second axis in response to movement of a second frame portion, the fourth connector constrained by the second frame to resist movement along the second axis; and wherein movement of the first and second frame portions permit selective engagement and disengagement between the first and second connectors and between the third and fourth connectors, each of the first and second frame portions being accessible from the open region.

13. The connector system of claim 12 wherein the second connector and the fourth connector are guidingly received at opposite ends of a hollow body disposed in the recessed space between the first and second frames.

14. The connector system of claim 13 wherein the body includes a flange extending longitudinally along the body, the flange extending over the opposite edges of the recessed space.

15. The connector system of claim 12 including a first cover pivotably connected to the first frame and a second cover pivotably connected to the second frame, the first cover movable to a locking engagement over the first frame and the second cover movable to a locking engagement over the second frame, upon engagement between the first and second connectors and between the third and fourth connectors.

16. The connector system of claim 15 wherein the first cover, second cover and body substantially prevent foreign matter from reaching the recessed space.

17. The connector system of claim 12 wherein the recessed space is a recessed slot having an open end.

18. The connector system of claim 12 wherein the recessed slot is formed in a surface of a device.

19. The connector system of claim 12 wherein the first and second frame include features for securing the first and second frame in the space.

20. The connector system of claim 1 wherein each of the first and second frame includes a pair of slots defining a predetermined path formed in opposed sides of the frame;

a first frame portion having a pair of lobes, each lobe slidably received in a corresponding slot of the first frame, a second frame portion having a pair of lobes, each lobe slidably received in a corresponding slot of the second frame, the first frame portion being substantially vertically slidably movable with respect to the first connector and the second frame portion being substantially vertically slidably movable with respect to the third connector; and wherein in response to substantially vertical sliding movement of the first frame portion, the first connector moves along the first axis and in response to substantially vertical sliding movement of the second frame portion, the third connector moves along the second axis.

* * * * *